United States Patent [19]

Dunne

[11] 4,015,349

[45] Apr. 5, 1977

[54] CHANGEABLE MESSAGE HIGHWAY SIGN MACHINE

[75] Inventor: Samuel B. Dunne, Dixon, Ill.

[73] Assignee: Fosco Fabricators, Inc., Dixon, Ill.

[22] Filed: Feb. 25, 1974

[21] Appl. No.: 445,627

Related U.S. Application Data

[63] Continuation of Ser. No. 106,100, Jan. 13, 1971, abandoned.

[52] U.S. Cl. ..... 40/33; 40/52 R; 40/77; 219/219

[51] Int. Cl.² ..... G09F 11/10

[58] Field of Search ..... 40/30, 33, 52, 68, 68.4, 40/77, 77.4, 77.6, 77.8, 77.7, 125 N, 125 H, 130 R, 130 L, 132 R, 132 D, 133, 135; 219/203, 218, 219; 340/22, 150, 324 R

[56] References Cited

UNITED STATES PATENTS

| | | | |
|---|---|---|---|
| 1,441,856 | 1/1923 | Jackson | 40/125 H |
| 1,739,592 | 12/1929 | Hyatt | 40/77 |
| 2,063,003 | 12/1936 | Curtiss | 40/133 R X |
| 2,817,914 | 12/1957 | Rosen | 40/132 R |
| 2,887,085 | 5/1959 | Aiken | 40/133 R X |
| 3,006,093 | 10/1961 | Burk et al. | 40/33 |
| 3,080,669 | 3/1963 | Zimmy et al. | 40/52 R |
| 3,160,736 | 12/1964 | Catterson | 219/219 |
| 3,256,512 | 6/1966 | Pickett et al. | 340/22 |
| 3,622,980 | 11/1971 | Elledge, Jr. | 40/129 C X;129 R X |

FOREIGN PATENTS OR APPLICATIONS

| | | | |
|---|---|---|---|
| 154,680 | 9/1952 | Australia | 40/33 |
| 1,170,262 | 11/1969 | United Kingdom | 40/125 H |

*Primary Examiner*—Anton O. Oechsle
*Assistant Examiner*—Vance Y. Hum
*Attorney, Agent, or Firm*—Burmeister, York, Palmatier, Hamby & Jones

[57] ABSTRACT

A highway sign machine adapted to be mounted in an overhead position proximate to a traffic lane operates under local or remote control to dis play selectively to motorists any of a plurality of written traffic messages on a vertical sign face covering the front profile of the machine and virtually duplicating the appearance of standard overhead signs for expressways that continuously display unchanging messages. A plurality of traffic messages are written longitudinally on angularly spaced message faces on rotors that are rotatably indexed to different message presenting positions where the rotors are accurately located and releasably held by rotary cam and follower means against vibration. Replaceable message panels on the rotors are supported by lightweight structure resistant to bending and vibration and comprising extruded corner chords having tubular bodies and integral flanges connected by diagonal webs underlying the message panels. Reliable operation even under freezing outdoor conditions is assured by a tight construction and deflectors which substantially exclude precipitation, the bridging of narrow interstices between relatively movable external parts being precluded by internal heating elements positioned and protected to consume little energy. Convenient operational capability in the event of an electric power failure is provided by an emergency low voltage electric drive by a local power source.

18 Claims, 3 Drawing Figures

Fig. 1.
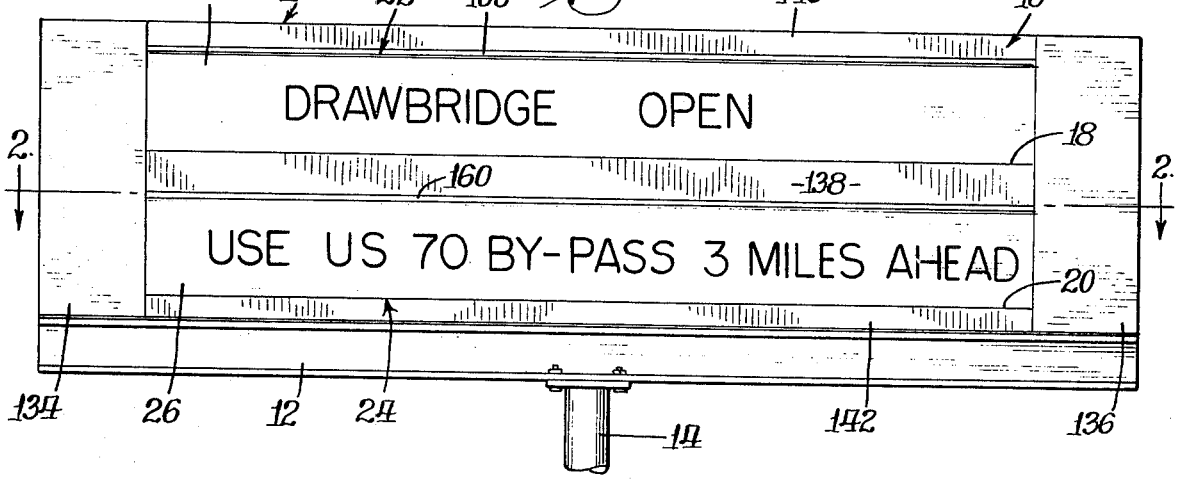
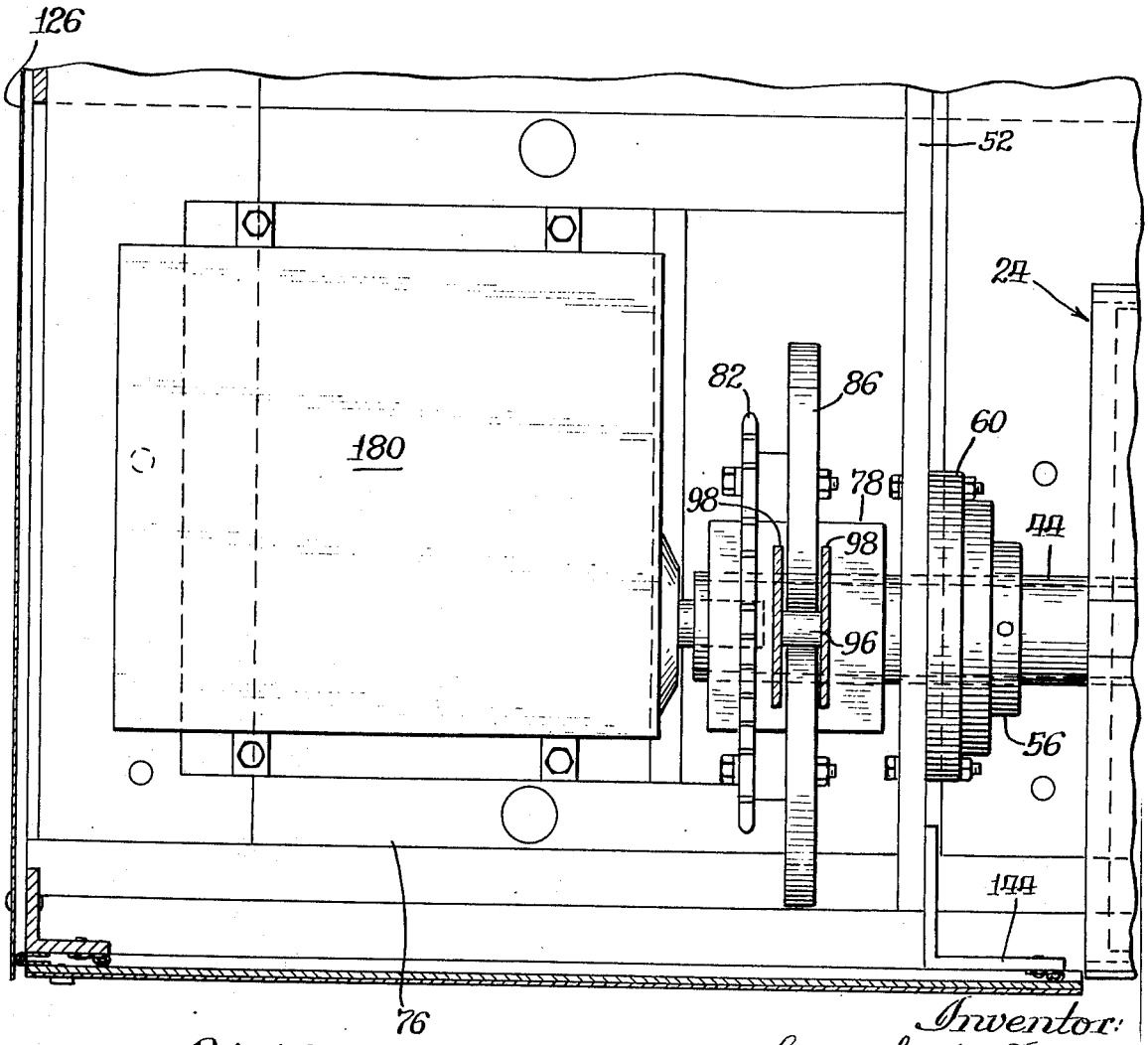
Fig. 3.
Inventor:
Samuel B. Dunne
By: Burmeister, Palmatier & Hamby
Attys.

Inventor:
Samuel B. Dunne
By: Burmeister, Palmatier & Hamby
Atty's.

Inventor:
Samuel B. Dunne
By: Burmeister, Palmatier & Hamby
Attys.

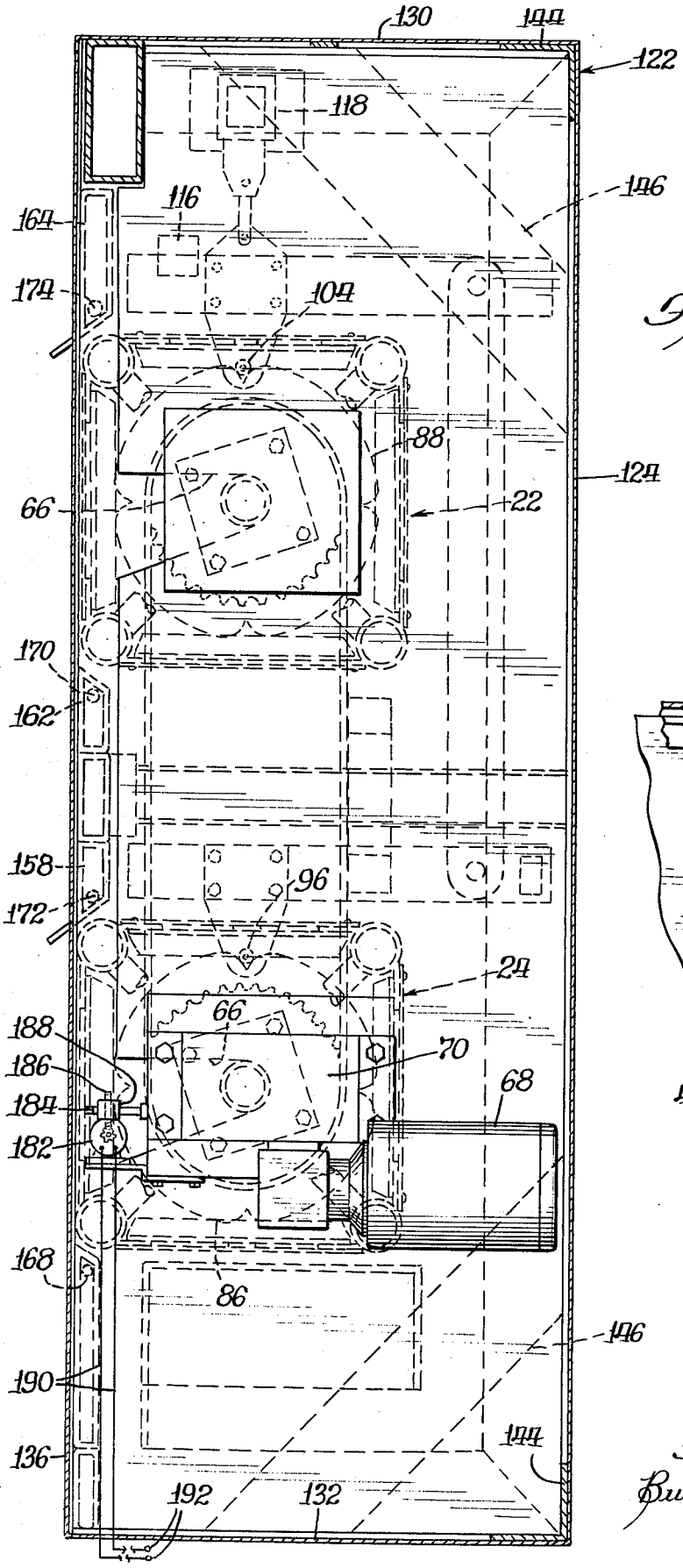
Fig. 10.
Fig. 7.
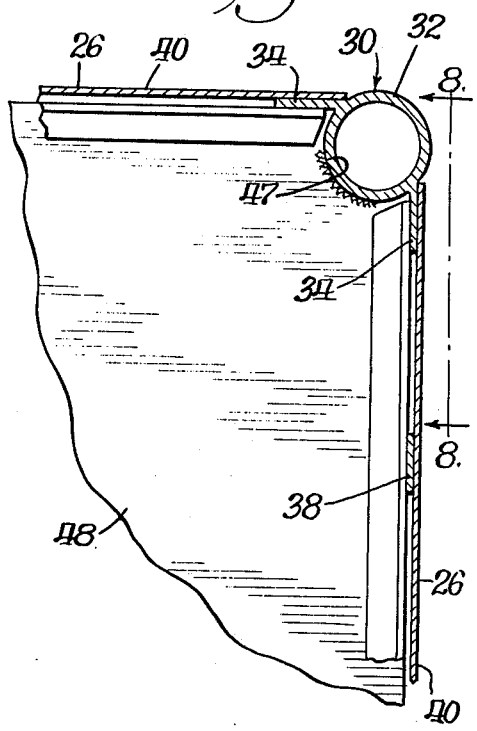
Inventor:
Samuel B. Dunne
By:
Burmeister, Palmatier & Hamby
Atty's.

Inventor:
Samuel B. Dunne
By: Burmeister, Palmatier & Hamby
Atty's.

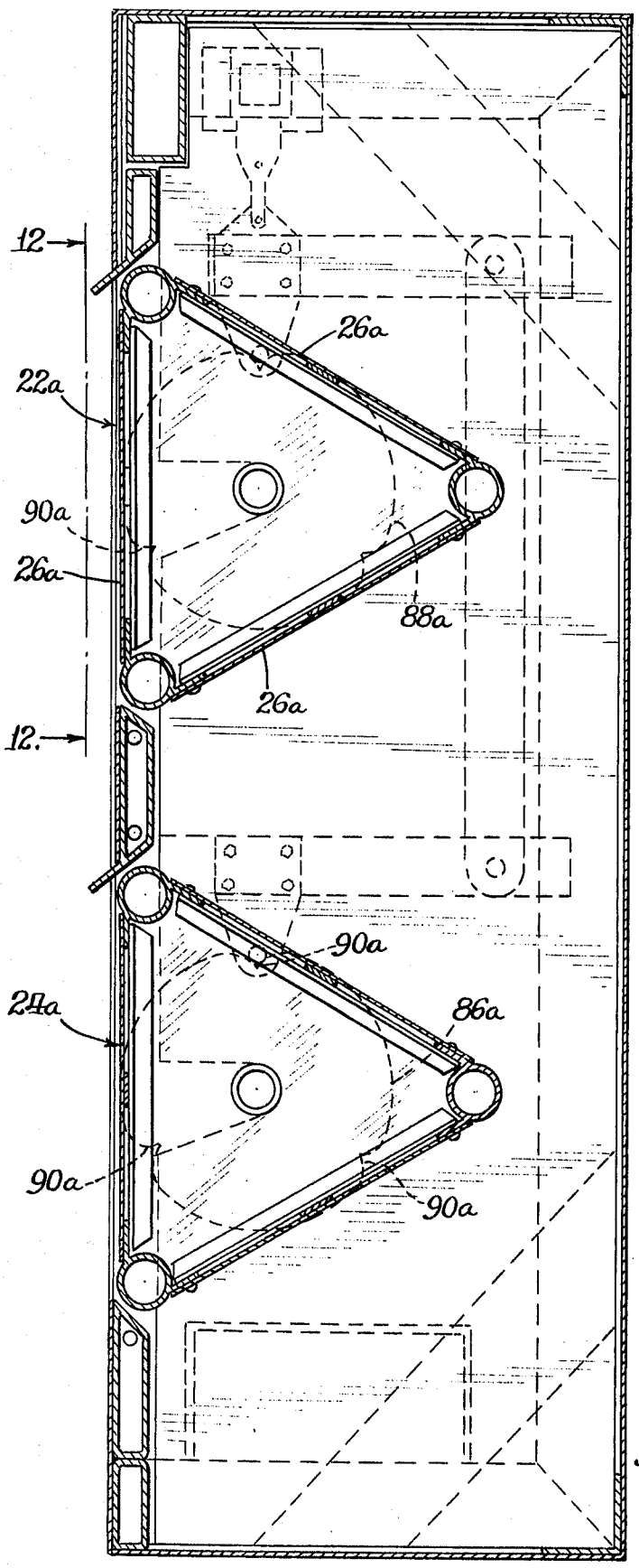
Fig. 11.
Fig. 13.
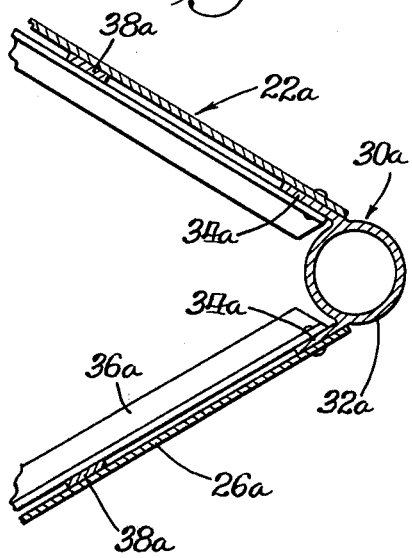
Inventor:
Samuel B. Dunne
By:
Burmeister, Palmatier & Hamby
Attys.

CHANGEABLE MESSAGE HIGHWAY SIGN MACHINE

This is a continuation of application Ser. No. 106,100, filed Jan. 13, 1971, now abandoned.

The present invention is concerned with the problem of controlling traffic on expressways where the normal progress of vehicles is subject to disruption by adverse transitory conditions such, for example, as congestive rush hour patterns, traffic stalling weather conditions, lane blockages caused by not infrequent accidents, the dispersion of large crowds from nearby sporting events and so forth.

As is painfully evident to motorists imprisoned in motor traffic jams, disruptions to the normal flow of traffic can temporarily nullify the enormous inherent advantages of expressways and cause heavy cumulative damage and not infrequent hardship to those who are delayed.

Streams of expressway motorists, uninformed of traffic impactions ahead and having no directions for taking alternate routes, can quickly accumulate into huge traffic jams that are most difficult for all concerned.

With a view to visually informing motorists with reference to transitory and possible difficult traffic situations ahead, one object of the invention is to provide, for disposition in overhead relation to a highway lane or lanes or in adjacent visual proximity thereto, driver direction display apparatus of new and improved construction that is selectively operable either locally or from a remote control station to display selectively and prominently to motorists any of a plurality of predetermined written messages that may include compulsory direction or advisory information appropriate for different conditions.

Another object is to provide driver direction display apparatus as recited which operates to display selectively any of a plurality of predetermined messages in prominent lettering in such manner that the normal appearance to motorists of the apparatus and the message displayed is substantially identical, for practical purposes, to the familiar appearance of overhead type driver direction signs in common usage on expressways for continuously displaying unchanging information to motorists.

A further object is to provide for motorists a changeable message sign machine which functions under local or remote control with great reliability and dependability under all weather conditions to display selectively any of a predetermined plurality of messages in lettering which, in its compositions and display, is similar or identical to that commonly standardized for use in overhead traffic signs that display fixed messages.

A further object is to provide for expressway use and the like a changeable message sign machine of the character recited which displays selectively any of a plurality of predetermined messages in wording that is sufficiently extensive and prominent to be read meaningfully by passing motorists while at the same time precluding the possibility of any driver being confused between a message being actively displayed and any other of the several messages stored in the sign machine for subsequent display selectively.

Another object is to provide, for displaying selectively compulsory or advisory messages to motorists, a new and improved sign machine of the character described that is marked by sturdiness, durability, permanence and appearance which correspond most favorably with similar qualities of conventional overhead signs for expressways that continuously display unchanging messages.

Another object is to provide a new and improved sign machine as recited in the preceding objects which can be effectively lighted by incident light in the same manner as standard fixed message signs in use on expressways.

A more specific object is to provide a changeable message highway sign machine as recited in which a plurality of different messages are stored and displayed on angularly spaced message faces on one or more rotors that are indexed selectively to a plurality of message display positions and effectively held against displacement by wind or other environmental forces from any display position until being released as an incident to normal indexing of the rotor.

A further object is to provide a changeable message highway sign machine of the character recited incorporating one or more message bearing rotors having a highly advantageous construction resistant to bending or vibration in all directions while at the same time being light in weight and inexpensive to manufacture.

Still another object is to provide for expressways a changeable message sign machine as recited in which one or more indexable message rotors are construed of lightweight corrosion resistant metal in a highly advantageous fashion which minimizes rotor weight while at the same time affording a high resistance to vibration and bending and defining a plurality of angularly spaced longitudinal message faces disposed in flush relation to longitudinal corners of the rotor to maximize the display area for individual messages in a machine of minimum size and serving further to advantage in affording the overall appearance to the motorist of a conventional fixed message sign of similar size.

A further object is to provide, for displaying selectively a plurality of traffic messages to expressway motorists, a sign machine of the character recited which is inherently well adapted for electrical operation under either local or remote control and which can, in the event of an electric power failure, be operated manually or by a locally applied low voltage power source, such as an automobile battery.

A related object is to provide a sign machine as recited which is well adapted to be controlled from a remote location by any of a plurality of control systems and which functions to accurately transmit back to the remote control station information as to the message being actively displayed.

Other objects and advantages will become apparent from the following description of the exemplary embodiments of the invention illustrated in the drawings, in which:

FIG. 1 is a motorist's view of a sign machine constructed in accordance with the invention and supported as shown atop a vertical column such as can be located alongside an expressway;

FIG. 3 is a fragmentary sectional view on a still larger scale corresponding to the left end portion of FIG. 2 and showing rotor turning and holding structure in conjunction with telemetering apparatus which signals the position of the rotor to a remote station;

FIG. 7 is a fragmentary transverse sectional view of one corner of the rotor taken with reference to the line 7—7 of FIG. 6;

FIG. 10 is a vertical sectional view of the right hand end portion of the machine taken with reference to the line 10—10 of FIG. 2;

FIG. 11 is a vertical transverse sectional view through a medial portion of the machine modified to incorporate three-sided message bearing rotors;

FIG. 13 is a transverse sectional view of the modified rotor taken with reference to the line 13—13 of FIG. 12.

Figure 2:
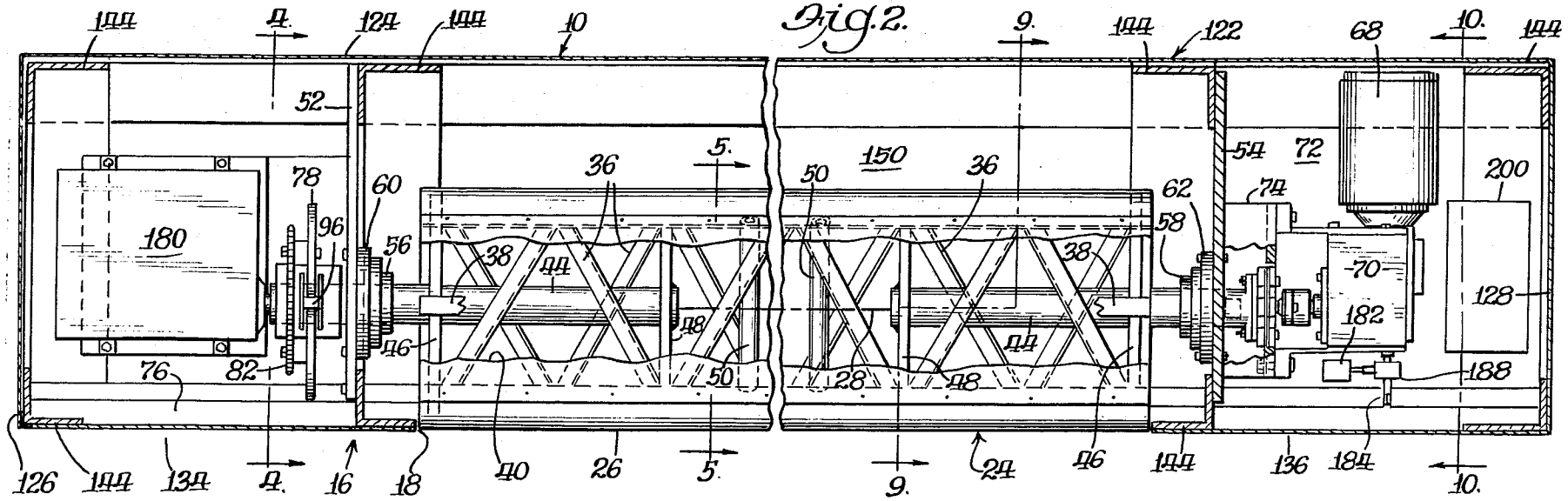
FIG. 2 is a horizontal medial sectional view on an enlarged scale of the sign machine taken with reference to the line 2—2 of FIG. 1.

Referring to the drawings in greater detail, the changeable message highway sign machine 10 embodying the invention is inherently adapted to be mounted in an overhead position in transverse proximity to a traffic lane in the same manner as conventional signs prescribed for common usage along expressways to continuously display unchanging message information to motorists. As shown, the changeable message sign machine 10 is mounted on an underlying horizontal support rail 12 surmounting a vertical support column 14 such as may be installed in accordance with standad signing regulations in proximate relation to the traffic lanes of an expressway.

As will presently appear, message displaying rotors incorporated into the machine 10 have great inherent strength and resistance to bending with the consequence that the rotors to be described and the overall machine 10 itself can be rather extensive in horizontal length so that the machine can span, if desired, more than one traffic lane, the machine being sustained in overlying relation to a traffic lane or lanes by supports under opposite ends of the machine or by horizontal truss or beam structure exending the length of the machine and supported at opposite ends in spanning relation to expressway traffic lanes in accordance with established conventional practices requiring no specific description here.

The changeable message highway sign machine 10 has a rectilinear overall form shaped so that the machine in its entirely presents transversely to the path of the oncoming motorist a vertical sign surface denoted generally in FIGS. 1 and 2 by the number 16.

As will presently appear, the sign surface 16 bears the lettering of the message being actively displayed by the machine 10 and extends over the entire profile of the machine confronting the motorist so that the motorist, in effect, sees nothing but the sign surface 16 which is, as a practical matter, continuous and coplanar throughout its extent. This extent, as indicated, is substantially coextensive with the height and the horizontal extent of the machine as presented to the motorist.

On this vertical sign surface or face 16, which covers the entire profile of the machine 10 seen by the motorist, is selectively displayed by the machine 10 as will presently appear any one of a plurality of informative messages or compulsory directions stored in the machine, all in the manner to be described.

The vertical sign surface or face 16 wherein the stored messages are caused to appear selectively can be lighted to advantage by incident light in the same manner as conventional standard signs continuously displaying unchanging messages. Moreover, the character of the lettering used in the composition of the individual messages displayed by the machine and the character of the background surface against which such lettering is presented and which extends preferably over the entire forward profile of the machine as indicated can be the same as the lettering and background surface commonly used in fixed signs of standard design for official driver direction messages and being so familiar to motorists.

As will appear, the capability of the machine 10 to display selectively any of a plurality of messages without distracting the motorist by an unfamiliar appearance aids in imparting helpful and often essential information to preoccupied minds having little time to concentrate on signs which must be accurately perceived at a glance.

To enable the motorist who may be travelling at rather high speed to scan the sign face 16 and accurately perceive the displayed message in a fleeting glance, the machine 10 is designed to display meaningful messages or complusory directions to drivers in wording that is sufficiently extensive in letters that are sufficiently large to be read and comprehended easily under pressing traffic conditions. At the same time, the overall size of the machine 10 required to display a written message of substantial complexity is minimized by a construction which facilitates the display of written wording in lines of sufficient length to accommodate much information and providing where required for the display of messages in multiple lines selectively by a machine of minimized thickness.

The machine 10 is designed to display written messages selectively in two elongated parallel display areas, to be described, accommodated within two horizontally elongated message apertures 18, 20 formed in the overall surface area of the sign face 16 in closely spaced relation to each other within the peripheral marginal edges of the sign face 16 as shown in FIG. 1.

Two elongated message bearing rotors, denoted generally by the numbers 22, 24, are journalled within the machine 10 in parallel relation to each other as will be described to display messages on individual message faces 26 that are selectively indexed into flush alinement with the respective message apertures 18, 20 for display visually as integral parts of the overall sign face 16.

Figure 5:
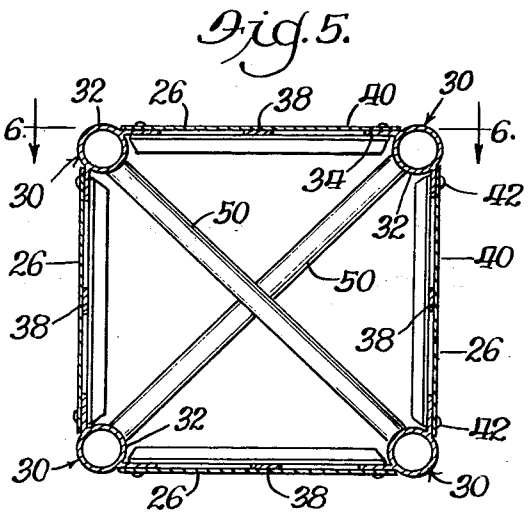
FIG. 5 is a fragmentary sectional view taken along the line 5—5 and showing in transverse section one segment of a message bearing rotor in the machine.
Figure 4:
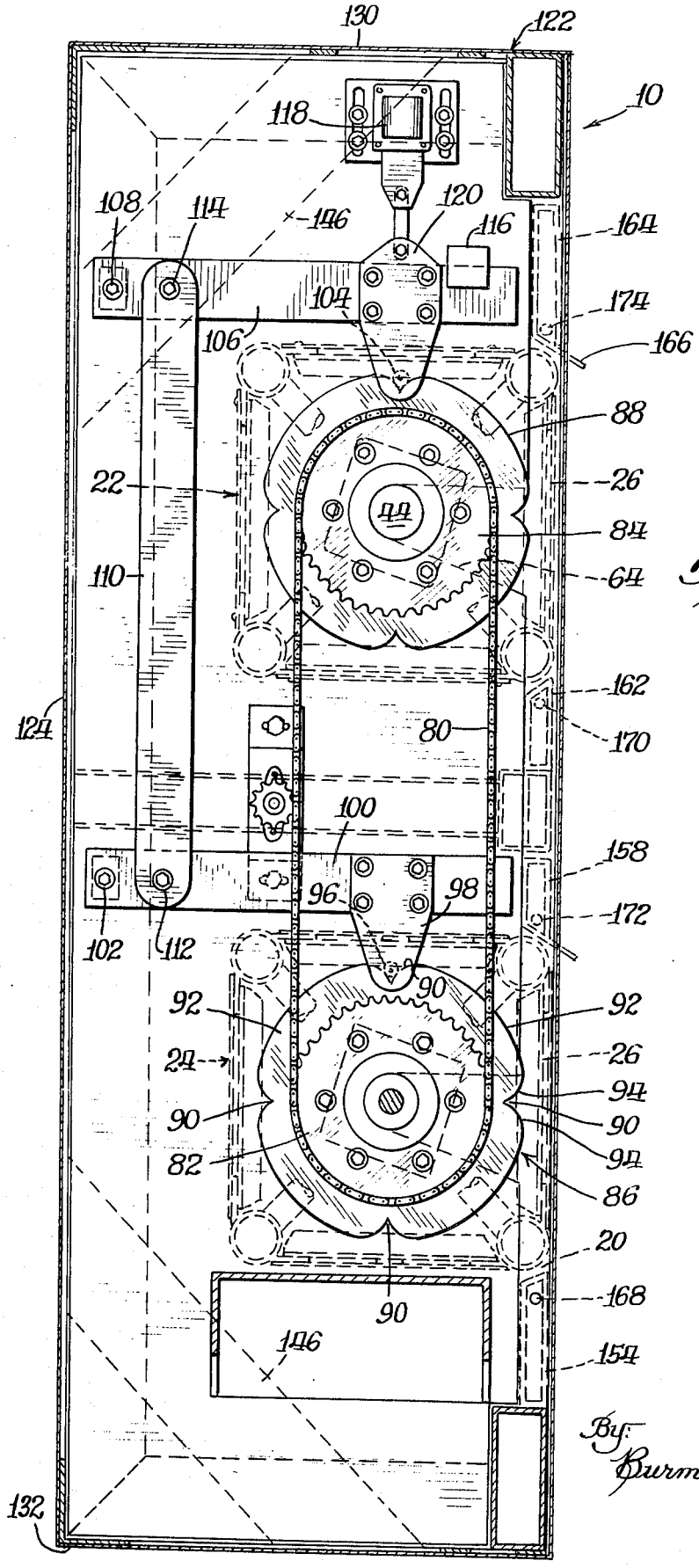
FIG. 4 is a vertical sectional view of the sign machine taken with reference to the line 4—4 of FIG. 2.

The basic mechanical construction of the two rotors 22, 24 incorporated into the sign machine 10 is identical. As shown in FIGS. 2, 4 and 5, the rotor 24, for example, has four longitudinal faces 26 evenly spaced circumferentially or angularly about the longitudinal axis 28 of the rotor and being flush with or tangential to the respectively adjacent corners of the rotor which has in this instance an overall shape that is square in transverse section, FIG. 5.

The rotor 24, as is the rotor 22, is formed of a highly advantageous construnction light in weight which provides in the rotor strength and high resistance to bending in all directions and to vibration under the excitement of what may be most powerful and irregular wind conditions to which the sign is sometimes subjected in its elevated position adjacent expressway traffic lanes that tend to become wind tunnels. More particularly, the rotor 24, for example, is constructed of four longitudinal corner chords 30 constituted by integral extrusions of light metal, preferably aluminum or an alloy of aluminum, and having a configuration in transverse section illustrated best in FIGS. 5 and 8.

Each extrusion 30, which becomes a chord denoted by the same reference number in the assembled construction, has a hollow cylindrical body 32 which joins integrally along its external cylindrical surface with two longitudinal reinforcing and attachment flanges 34 projecting from the tubular body 32 in slightly inwardly offset relation to outer tangents to the external surface of the tubular body 32. The two flanges 34 formed in one piece with the tubular body 32 of the corner extrusion or chord 30 are respectively parallel to the two adjacent message faces 26 on the rotor 24 and in this instance are mutually perpendicular, the rotor 24 having a square shape in transverse section.

Figure 6:
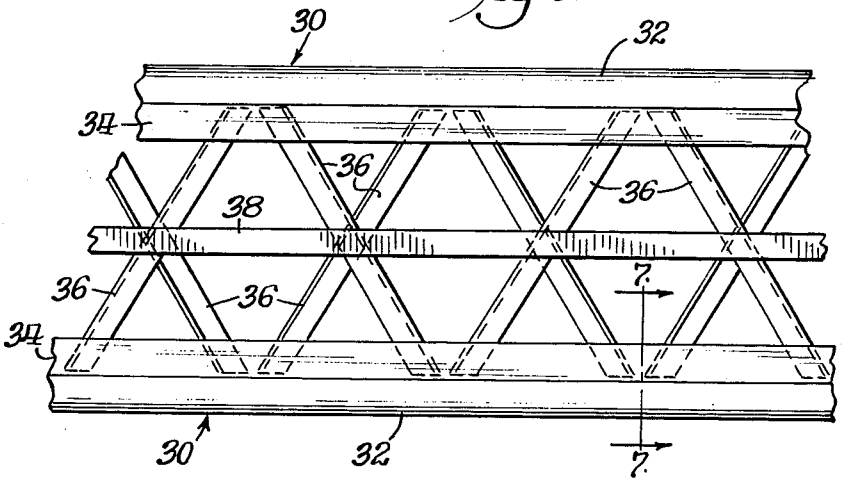
FIG. 6 is a horizontal section view taken along the line 6—6 of FIG. 5 and showing the frame structure of a message bearing rotor.

Thus, the four longitudinal corner extrusions 30 form the four corners of the rotor 24 as illustrated. In underlying relation to each respective message face 25, the two mutually parallel reinforcing and attachment flanges 34 of the two adjacent extrusions or chords 30 are connected together in truss-like fashion by a plurality of diagonal web members 36 disposed in a zig-zag pattern extending between opposite ends of the rotor as best shown in FIGS. 2 and 6. Like the extrusions 30, the web members 36 are formed of aluminum or other noncorrosive light metal, the individual web members being shaped as "angles" with two joined and mutually perpendicular leg portions in transverse section which mutually reinforce each other to make the web members 36 resistant to bending loads. Opposite ends of each web member 36 fit flat against the undersurfaces of the joined corner extrusion flanges 34 to which such ends of the web members are attached firmly in any suitable manner as by riveting, welding, bolting or the like.

Also in underlying relation to each message face 26 on the rotor 24, a longitudinal support strip 38 formed of light corrosion resistant metal and having a thickness equal to the thickness of the corner extrusion flanges 34 is secured to the outer faces of the underlying zigzagging webs 36 in a medial position between the two adjacent corner extrusions as shown in FIGS. 2 and 5. The medial longitudinal strip 38 and the two corner flanges 34 underlying each message face 26 provide three mutually parallel spaced supports for a rectangular message plate or panel 40 extending between the two adjacent corners of the rotor and running the length of the rotor to support lettering of a predetermined message and provide for such lettering a flat background surface which becomes a part of the overall sign face 16 presented to the motorist, as will presently appear.

To facilitate replacement of any message stored in the sign with a different message to be displayed, the message panels or plates 40 are preferably secured detachably to the underlying corner flanges 34 by releasable securing means such, for example, as screws 42.

To support the rotor 24 for rotation about its axis 28, two trunnion shafts 44 are mounted within opposite ends of the rotor as shown in FIG. 2. Each trunnion shaft 44 is fixed in coaxial relation to the rotor by means of two axially spaced mounting plates 46, 48. Each plate 46, 48 is centrally apertured to receive the coacting trunnion shaft 44 which is welded in place within the plate as shown. Moreover, each plate has a generally square shape with arcuate notches 47 in the four corners of the plate cradling the respective chord extrusions 30 secured by welding to the plate corners.

The rotor 24 can be fashioned, if need be, to have a very extensive length to accommodate long lines of prominent lettering. Thus, the rotor can have sufficient length to extend across more than one traffic lane in the event this is required to accommodate and prominently display any line of wording which it may be expedient to place on a single rotor as will presently appear.

In a rotor of extensive length, the medial portion of the rotor can be diagonally braced to advantage, as shown in FIGS. 2 and 5, by transverse braces 50 of hollow cylindrical construction extending transversely between diagonally opposite corner extrusions 30 and having opposite ends recessed to fit against the cylindrical tubular portions 32 of the corner extrusions 30 to which the recessed ends of the braces are securely welded.

The two rotors 22, 24 are supported for rotation in parallel relation to each other by two vertical support partitions or bulkheads 52, 54 internally disposed in the machine 10 to extend across the machine in transverse relation to the rotors at opposite ends of the rotors as shown best in FIG. 2.

More particularly, the two trunnion shafts 44 projecting from opposite ends of the rotor 24, for example, extend respectively through two encircling journals 56, 58 which rotate with the respective trunnion shafts. The journals 56, 58 are rotatably supported respectively by two encircling bearings 60, 62 bolted to the respective support partitions or bulkheads 52, 54. The projecting ends of the trunnion shafts 44 and the supporting journals and bearings for the trunnion shafts are accommodated within deep notches 64, 66 formed in the respective support partitions 52, 54 and opening forwardly to facilitate assembly of the rotors into the machine through the message apertures 18, 20.

The message bearing rotors 22, 24 are indexed rotatably to turn the individual message faces 26 on the respective rotors in succession into alignment with the message apertures 28, 20 in the overall vertical sign face 16 of the machine where the rotor message faces 26 fill the respective message apertures 18, 20 in coplanar relation to the surrounding background surface area of the overall sign face 16.

In installation where it is desirable to change at once the portions of the message displayed by both rotors through the tiered message apertures 18, 20, provision is made as in the instant machine 10 for rotatably indexing both rotors 22, 24 in unison. In situations where the messages are stored in the machine for selective display are such that advantageous is advantaeous to effect a change in the message displayed by one rotor independently of the message being displayed by the other rotor or rotors, the power indexing means to be described for rotatably indexing the rotors can be duplicated for each of the rotors.

As shown best in FIGS. 2 and 10, the rotor 24 is turned selectively through successive angles of rotation corresponding to the radial angles of the successive message faces 26 on the rotor. For this purpose, a rotor indexing electric motor 68 is connected through a speed reducing transmission 70 with the end of the righthand trunnion shaft, FIG. 2, that projects through the support bulkhead 54 into an end compartment 72 of the machine 10 wherein the motor 68 and transmission 70 are accommodated and mounted on the adjacent vertical face of the support bulkhead 54 by suitable bracket means 74.

A transmission 70 and electric drive motor 68 of adequate power and torque capacity for this purpose can be obtained from commercial sources. The construction of transmissions as such which will serve the function desired here in angular indexing of the rotor 24 is known to those skilled in the transmission art and requires no detailed description here, it being contemplated that the motor 68 and transmission 70 as such are to be purchased from commercial suppliers.

The opposite trunnion shaft 44 projects from the lefthand end of the rotor 24, FIG. 2, through the support bulkhead 52 into left end compartment 76 of the machine 10 wherein the left trunnion shaft 44 is encircled by a coupling 78 nonrotatably secured to the shaft.

In the machine 10, the rotor 22 is indexed rotatably in synchronism with the rotor 24 by means of an endless sprocket chain 80, FIG. 4, trained around a lower sprocket wheel 82, bolted to the coupling 78 in concentric relation to the adjacent shaft 44 and trained around an upper sprocket wheel 84 nonrotatably supported on the corresponding trunnion shaft 44 for the upper rotor 22.

As previously indicated, the upper rotor 22 has a physical construction essentially the same as that of the lower rotor 24, the upper rotor 22 being supported by trunnion shafts 44 journalled in the supporting bulkheads 52, 54 in the same manner as the trunnion shafts 44 for the lower rotor. The two rotors 22, 24 thus connected by the endless sprocket chain 80 are indexed in unison by the power indexing motor 68 operating through the transmission 70 as described.

Accurate positioning of the two rotors 22, 24 in any message displaying position to which they are turned by the power driven transmission 70 is assured by final positioning and retaining means to be described which also functions to yieldably yet firmly hold the rotors in the selected message display positions against rotary displacement from such positions by vibratory wind forces and other disruptive environmental forces that can prevail in the exposed outdoor environment where the machine is normally installed.

As best illustrated in FIGS. 2, 3 and 4, a multiplelobed cam disc 86 is mounted concentrically on the coupling 78 for rotation with the trunnion shaft 44 projecting from the adjacent end of the lower rotor 24. A substantially identical multiple-lobed cam disc 88 is similarly mounted above the cam 86 on the corresponding trunnion shaft 44 supporting the corresponding end of the upper rotor 22. The lower cam disc 86, which is structurally identical to the upper cam disc 88, defines in its periphery four indentations 90 uniformly spaced at 90 degree intervals around the axis of the cam and corresponding respectively to the four uniformly spaced message faces 26 on the rotor 24.

The indentations 90 are separated by intervening lobes 92. Opposite sides of each indentation 90 are defined by cam surfaces 94 which curve inwardly in converging relation to each other to contact a coacting cam follower 96, FIGS. 2, 3, and 4, and receive a circumferential reaction from the cam follower as will presently appear.

The cam follower 96 which coacts with the cam 86 is supported in confronting relation to the periphery of the cam 86 for movement in a generally radial direction with reference to the axis of the cam. In the preferred construction illustrated best in FIGS. 3 and 4, the cam follower 96 is fashioned as a roller journalled between a pair of brackets 98 fixed to a cam follower support lever 100 swingably mounted on a support pivot 102 for swinging movement in a plane generally parallel to the plane of cam 86, the cam follower roller 96 being located a rather substantial distance from the lever pivot 102 so that the cam follower roller 96 moves in a rather flat arc radially disposed relative to the cam 86 to follow the periphery of the cam.

The upper cam 88, identical in construction to the lower cam 86 but mounted for rotation with the upper rotor 22, coacts with a cam follower roller 104 similar to the cam follower roller 96 and supported in the manner of the cam followr 96 on a lever 106 swingably supported on a pivot 108 and being practically identical to the lower cam follower support lever 100. The two cam follower support levers 100, 106 are forced to swing together in parallel relation to each other by a connecting link 110 having pivotal connections 112 and 114 to the two respective levers 100, 106 that are equally spaced from the lever support pivots 102, 108.

The cam followers 96 and 104 and the supporting lever structure for the cam followers are disposed in overlying relation to the respective cams 86, 88 so that the combined weight of the movable cam follower support structure acts to urge the cam followers continuously toward the peripheries of the cams. The forces with which the cam followers are urged toward the cams can be increased as may be found expedient by adding a weight 116 to the movable cam follower support structure, the weight 116 being positioned on the free end of the lever 106 as shown in FIG. 4.

The rotor controlling action of the cams 86, 88 and followers 96, 104 is suspended, during normal indexing of the rotors, by means of a solenoid 118 connected as shown in FIG. 4 to the cam follower support brackets 120 of the upper lever 106 to swing the mechanically interconnected cam support levers 100, 106 simultaneously away from the respective cams 86, 88.

The cam releasing solenoid 118 is energized simultaneously with energization of the motor 68 to rotate the rotors 22, 24 to new positions to present in the sign face 16 a newly selected message written on rotor message faces 26 selected for display. As the rotors 22, 24 reach the proper rotary positions for displaying the desired message through the apertures 18, 20, the indexing motor 68 and solenoid 118 are deenergized whereupon the weight of the movable cam structure support urges the cam followers 96, 104 toward the lower points of the indentations 90 of the cams 86, 88 that are brought into alignment with the respective followers as the selected rotor message faces 26 move into message displaying positions.

The two cam followers 96, 104 act on the cam surfaces 94 forming the sides of the engaged cam indentations 90 producing reactions on the respective cams 86, 88 which are effective, in the event an individual rotor is not precisely located in the desired position, to produce such incremental rotary movement of a misaligned rotor or rotors as may be necesssary to assure accuracy in the positioning of the rotor in the course of which each cam follower becomes seated against both sides of the coacting cam indentation 90.

The capability of the cam followers 96, 104 acting in conjunction with the curving cam surfaces 94 bounding the cam indentations 90 to incrementally turn the rotors 22, 24 to correct errors in the final positioning of the rotors by the indexing motor 68 serves the dual advantages of assuring accurate positioning of the rotors and of minimizing the need for precision in the control of the indexing motor 68 in turing the rotors to new message displaying positions. By reason of the firm seating of the cam followers 96, 104 in the cam indentations 90 and absence of significant "play" in the follower support pivots 102, 108, there is an effective absence of lost motion in the rotor holding structure. Hence, each rotor is firmly secured against rotary vibration by vibratory wind conditions and the like.

The machine 10 is so constructed that its physical structure and its dependability in operation to display any message borne by the rotors 22, 24 and its capability to change the message being actively displayed are not adversely effected by outdoor weather conditions, even freezing conditions, to which the machine and its moving parts are exposed.

Having a generally rectangular form over all, the machine 10 is self-encased wihin a rectilinear case, denoted generally by the number 122, FIGS. 2, 4 and 10, comprising a back panel 124 and two end panels 125, 128 extending vertically between a flat horizontal top panel 130 and a flat horizontal bottom panel 132. The previously-mentioned vertical rectangular sign face 16 on the machine is formed by two front side panels 134, 136 adjoining the respective end panels 126, 128, FIGS. 1 and 2, and extending vertically between the top and bottom panels 130, 132 at opposite ends of the message apertures 18, 20 normally filled by message faces 26 on the rotors 22, 24.

The two message apertures 18, 20 are separated by a central longitudinal front panel 138 and are bounded both above and below the aperture 18 and the aperture 20 respectively by front edge panels 140, 142 extending longitudinally between the front side panels 134, 136. The front panels 134, 136, 138, 140, and 142 are all substantially coplanar and in the preferred construction described substantially flush with the rotor faces 26 actively displayed in the apertures 18, 20, all the front panels mentioned being covered with a reflective covering of the standard character prescribed for direction signs for expressways.

The outer panels of the machine thus described are connected together and firmly supported internally with respect to the machine 10 by a plurality of linear frame members 144 formed preferably of a noncorrosive metal and extending, as shown in FIGS. 2 and 10, vertically and horizontally within the machine generally at the corners of the case 122. Some of the frame members 144 function in anchoring the support bulkheads 52, 54 disposed transversely in the machine inwardly of the respective end panels 126, 128 as shown in FIG. 2 and supporting the rotors 22, 24 as previously described.

Corner braces 146 placed diagonally in the corners of the casing 122 reinforce the casing against wind loads and other forces tending to produce bending stresses concentrated in the corners of the casing. The capability of the casing to sustain externally applied bending loads is enhanced by shaping many of the reinforcing structural members 144 to have the shape in transverse section of a right angle as shown best in FIG. 2.

The right end compartment 72 and the left end compartment 76 of the machine 10, FIG. 1, are tightly enclosed to effectively seal out precipitation and excessive moisture. A medical compartment 150 of the machine 10 containing the rotors 22, 24 and extending longitudinally between the support bulkheads 52, 54 is effectively protected against the intrusion or accumulation of precipitation, even under icing conditions, so that there is no interference with operation of the machine by water in either liquid or solid form.

The two message apertures 18, 20 which open into the medical compartment 150 are filled normally by message faces 26 on the rotors 22, 24 normally presented for viewing in the respective messsage apertures 18, 20. Thus, the rotors are designed to provide a rather close working fit between the ends and longitudinal sides of the rotor message faces 26 and the end and side edges of the corresponding message apertures 18, 20 as shown in FIGS. 1, 2 and 4.

Figure 9:
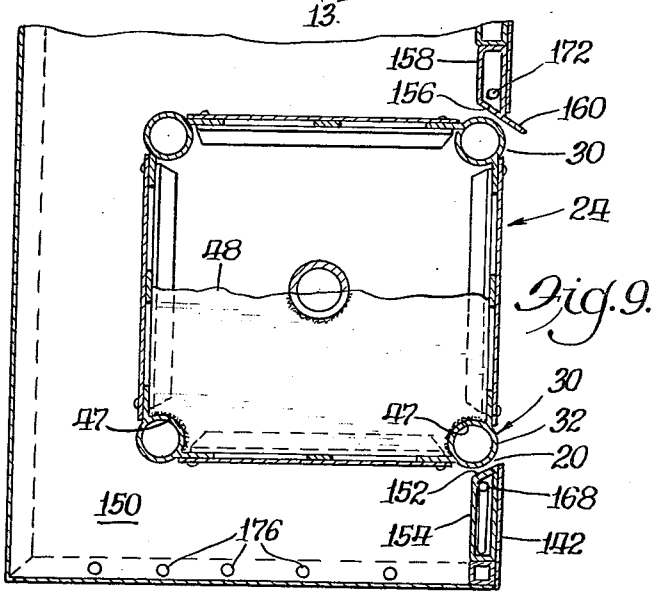
FIG. 9 is a medial transverse sectional view of the lower half portion of the machine taken with reference to the irregular line 9—9 of FIG. 2.

As shown best in FIG. 9, the lower longitudinal edge of the lower message aperture 20 is defined by the sloping upper edge 152 of a horizontal casing frame member 154, the edge 152 being disposed in a generally tangential but slightly spaced positional relation to the cylindrical body 32 of the adjacent corner chord 30 of the rotor 24.

The frame member 154 defining the surface 152 is fashioned as a segment of a generally flat hollow extrusion of noncorrosive light metal, preferably aluminum. The upper longitudinal edge of the message aperture 20 is defined by the downwardly and outwardly sloping surface 156, FIG. 9, of an overlying hollow frame member 158 also formed preferably as an aluminum extrusion. The surface 156 has a generally tangential but somewhat spaced positional relation to the adjacent upper corner chord 30 of the rotor 24.

The closely adjacent relationship of the two casing surfaces 152, 156 to the rotor structure presented in the message aperture 20 effectively minimizes the opportunity for snow, for example, to enter the compartment 150 through the message aperture 20 around the rotor 24. Rain impinging on and flowing down the sign face 16 above the message aperture 20 is diverted from the sign face above the aperture 20 to drop freely past the aperture 20. For this purpose, a water-diverting lip 160 is formed integrally on the extrusion constituting the frame member 158 to project downwardly and forwardly beyond the upper outer corner of the rotor 24 as an overlying continuation of the surface 156 as shown in FIG. 9. The water-diverting lip 160 thus formed extends longitudinally over the full horizontal length of the lower aperture 20 as shown in FIG. 1.

In a similar fashion the lower edge of the upper message aperture 18 is bounded by an extrusion 162 generally similar to the extrusion 154 bounding the lower edge of the lower aperture 20. Further in similar fashion, the edge of the upper message aperture 18 is bounded by an upper extrusion 164, generally similar to the extrusion 158 bounding the upper edge of the lower aperture 20. A longitudinal water-diverting lip 166 on the upper extrusion 164 extends downwardly and forwardly from the upper edge of the upper aperture 18 to divert water from the aperture 18 in the same manner as the lower water-diverting lip 160.

It is contemplated that the sign machine 10 may function to display the same message indefinitely under icing conditions in freezing weather. Yet, the machine remains continuously in readiness to index the messae bearing rotors 22, 24 upon command to change the message being actively displayed. To assure the absence of an accumulation of ice between the edges of the message apertures 18, 20 and the adjacent corners of the rotors 22, 24, electrical heating resistors 168, 170 are placed within the upper portions of the hollow extrusion 154, 162 bounding the lower edges of the apertures 18, 20. For the same purpose, similar electrical heating resistors 172, 174 are placed within the lower marginal edges of the upper extrusions 158, 164 to prevent the accumulation of ice along the upper edges of the message apertures 18, 20.

The electrical power required for operation of the heating resistors which preclude ice accumulation around the outer longitudinal faces of the rotors 22, 24 is advantageously minimized by the accomodation of the resistor heating elements within the protection of the hollow extrusions described so that the heat is conserved to flow by conduction to the adjacent extreme edges of the extrusions to preclude the buildup of ice.

Preferably, sign machines exposed to severe winter conditions have electrical heating elements 176 placed in the bottom of the medial longitudinal compartment 150, as shown in FIG. 9, to melt any snow which may sift into the compartment 150 around the rotors so that the snow drains off as water or is vaporized so as not to accumulate in the compartment 150 and interfere with indexing of the rotors, it being appreciated that the capability of the machine to display messages selectively may be most needed in snowy and icing conditions.

The message bearing rotors 22, 24 are controllably indexed selectively to any message displaying position corresponding to the respective message bearingfaces 26 on the rotors as described, such indexing being effected by simultaneous energization of the indexing motor 68 and the retracting solenoid 118 which releases the rotors for indexing.

The positions to which the message bearing rotors 22, 24 are indexed are signalled to a remote control station for the machine by an electrical signalling or telemetering unit 180 housed in the compartment 76, as shown in FIGS. 2 and 3, and connected to the adjacent trunnion shaft 44 for the lower rotor 24. A telemetering unit suitable for this purpose can be purchased from commercial sources for incorporation into the machine 10. As the construction of such signalling equipment is well known to those skilled in the telemetering and signalling act, it need not be specifically described here.

In the event of a general power failure or other circumstance which prevents normal operation of the indexing motor 68 when changing of the message displayed is desirable, the machine, nevertheless, can be operated locally by an authorized person having a 12-volt battery, such as that normally installed in an automobile, conveniently available near the base of the support 14 for the sign machine. For such emergency operation of the sign machine 10, a low power 12-volt electric motor 182, FIGS. 2 and 10, is connected to a manual operating shaft 184 for the indexing transmission 20 by a speed-reducing transmission 186, in this instance a worm and worm wheel, connected to the shaft 184 by a suitable overrunning clutch 188.

As indicated schematically in FIG. 10, power leads 190 from the 12-volt emergency drive motor 182 can be extended down to input contacts 192 located at a level above the ground convenient for energization by a 12-volt battery to effect slow but effective indexing of the rotors 22, 24, the torque supplied to the manual shaft 184 by the motor 182 through the emergency speed-reducing transmission 186 being sufficient to forcibly turn the retaining cams 86, 88 against the yieldable resistance of the coacting followers 96, 104, FIG. 4. The clutch 188 allows the main indexing transmission 70 to overrun normally in relation to the emergency drive energized by the 12-volt motor 182.

To provide ultimate assurance of an operational capability even in the event of a failure of the low voltage emergency drive described, the rotary manual shaft 184 is adapted at its outer end to be cranked manually after removal of the front side panel 136 from the machine 10 to expose the right end compartment 72 within which the indexing drive is accommodated.

Figure 12:
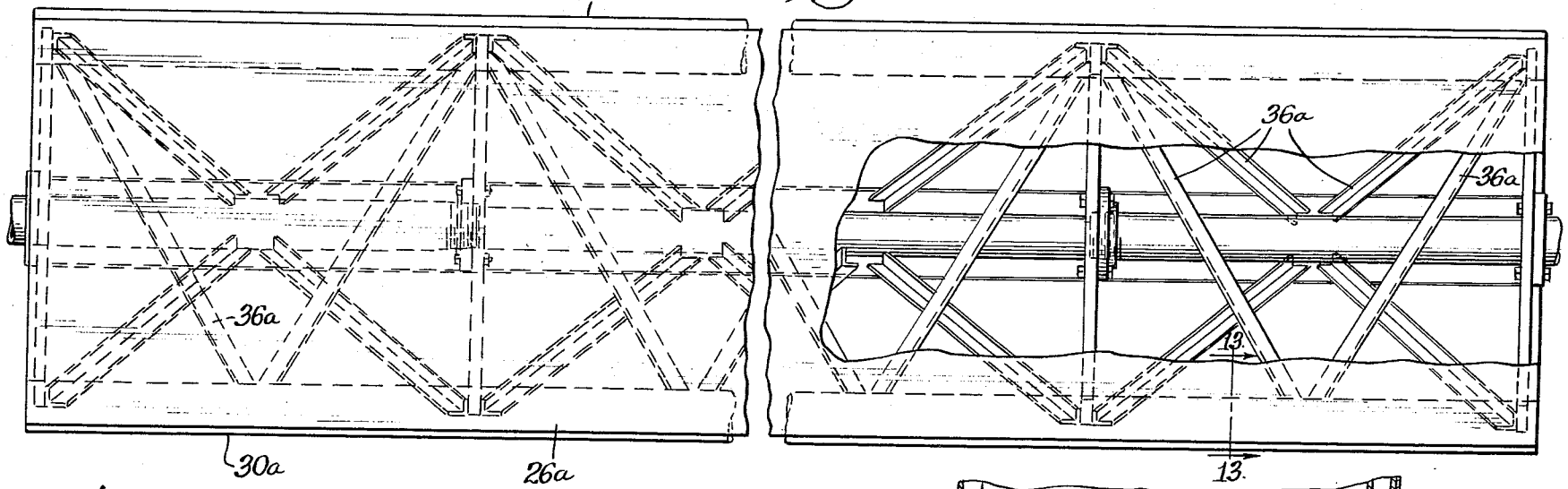
FIG. 12 is a fragmentary elevational view taken with reference to the line 12—12 of FIG. 11 and showing a rotor of modified construction incorporated into the machine of FIG. 11.

Component elements of the sign machine **10*a* constituting the modified embodiment of the invention illustrated in FIGS. 11 to 13,** which are counterparts of the machine described, are denoted by the same reference numbers with the addition of the suffix *a*. In the machine **10*a*, the two message bearing rotors 22*a*, 24*a* have the overall shape in transverse section of equilateral triangles, FIG. 11, each rotor defining three longitudinal message faces 26*a*** equally spaced angularly about the axis of the rotor.

Structurally, each of the rotors **22*a*, 24*a* comprises three corner chords 30*a* formed as extrusions of corrosion resistant light metal, preferably aluminum. In this instance, the two reinforcing and connecting flanges 34*a* integral with the tubular body 32*a* of each corner extrusion 30*a*** are disposed at an angle of 60° relative to each other.

The two support flanges **34*a* formed on adjacent chords 30*a* and underlying each message face 26*a* are firmly connected by a zig-zag pattern of diagonal webs 36*a*, as illustrated in FIGS. 11 to 13, so that each rotor thus formed has a most sturdy lightweight construction highly resistant to bending or vibration in any direction even under the vibratory wind loads to which the sign machine is exposed. Each cam disc 86*a*, 88*a* rotatable with the respective rotors 22*a*, 24*a* is shaped, as shown in FIG. 11, to define three rotor retaining recesses 90*a* corresponding to the three message faces 26*a*** on the rotor and positioned for holding the respective message faces in message displaying positions.

Each of the two sign machines 10 and **10*a* described incorporates a plurality of message bearing rotors which afford the dual advantages of providing in the aggregate an overall message display area in the sign face 16 of the machine 10,** for example, which has a rather extensive vertical extent for accommodating a multiple-line message while at the same time minimizing the aggregate structural size and mass of the rotors and minimizing the requisite horizontal thickness of the machine required to display a message of a given overall height.

While two display rotors are incorporated in each of the machines 10 and **10*a***, it will be appreciated that the invention is not limited to the use of two rotors and that more parallel rotors can be incorporated into the sign machine of the invention to accommodate any reasonable number of lines of wording. By virtue of using a larger number of rotors to display more complex messages occupying more lines, the size of the sign machine required is increased only in direct proportion to increases in the size of the changeable message display area and not in geometrical relation to increases in the size of such area.

As previously indicated, the power indexing structure can be duplicated if desired for each of the rotors so that the rotors can be indexed independently of each other to provide a greater selectivity in the active display of messages stored in writing on the message faces 26*a*. While advantages are obtained in using a multiplicity of rotors in individual sign machines where this is expedient to accommodate the most complex message to be displayed, it will be appreciated that the machine can have only a single rotor message face is sufficient to accommodate the most complex message.

Moreover, machines embodying the invention can incorporate three-sided rotors as in the machine 10*a*, or four-sided rotors as in the machine 10 as described, or message bearing rotors having a smaller or larger number of individual message bearing faces which are preferably flat.

It will be appreciated that the indexing motor 68 of the machine 10, for example, is energized by an ordinary power source of 110 or 220 volts nominally. Energization of the indexing motor 68 and the rotor releasing solenoid 118 of the machine 10 is controlled by suitable circuits adapted for remote control operation and having components housed in the weather protected compartment 72 in the right hand end of the machine, FIG. 2, and represented schematically in FIG. 2 by the internal control box 200. The specific character of the circuitry used to control energization of the indexing motor 68 and the solenoid 118 and the circuitry used to feed back messages from the telemetering unit 180 to confirm the position actuallly occupied by the rotors can take a number of forms, any of which can be provided and adapted to the machine 10 by electrical engineers using conventional components.

In general, the simplest control and feedback monitoring circuits can use one position control wire for each message face of each independently controlled rotor and one rotor position confirmation wire for each message face of each independently controlled rotor together with a suitable number, usually two, of common wires. Such position control and position confirmation wires can be contained in a common cable extending from a remote control station. In the alternative, the control circuitry for indexing the rotors and confirming the positions of the rotors can incorporate commercially available tone controls, similar to that used in telephone circuits, which can transmit and receive up to 80 separate and discrete tones on a single pair of wires for controlling and monitoring one or more sign machines.

In general, the sign machines 10 and 10 *a* can be controlled and monitored from a remote control station using any sutiable telemetering system which is most practical for local conditions and most acceptable to highway engineers in authority.

The invention is claimed as follows:

1. For displaying selectively to motorists any of a plurality of traffic messages, a changeable message highway sign machine comprising a casing adapted to be mounted in an overhead position proximate to a highway traffic lane to confront oncoming motorists, the motorist confronting side of said casing being shaped to form a vertical sign face, said casing defining in said sign face a message aperture a message bearing rotor defining on the periphery thereof a plurality of message faces extending longitudinally along the rotor and being angularly spaced around the rotor, each message face being adapted to support lettering of a written message, said rotor being disposed rotatably within said casing in aligned relation to said message aperture, bearing means in said casing journalling said rotor for rotation about the longitudinal axis thereof, power indexing means housed in said casing and coacting with said rotor to turn the rotor to message presenting positions thereof wherein the respective message faces thereon are disposed in viewing alignment with said message aperture to be displayed therethrough to oncoming motorists, said casing including a first hollow linear member defining the lower edge of said message aperture and having a downwardly and inwardly sloping upper edge surface closely confronting the rotary path of the periphery of the rotor, electrical resistance element means disposed longitudinally within said first linear member in proximate relation to said upper edge surface thereon to thermally preclude an icing bridgeover between the rotor and the lower edge of the message aperture, said casing including a second hollow linear member extending along the upper edge of said message aperture and defining a downwardly and outwardly sloping lower edge surface closely confronting the rotary path of the rotor periphery, said second member including a water deflector projecting downwardly and outwardly over the upper marginal edge of said message aperture to deflect downwardly flowing precipitation from the rotor, electrical resistance element means disposed in said second member in proximate relation to said sloping lower edge surface thereof to preclude an icing bridgeover between the rotor and the upper edge of the message aperture, and a cam and cam follower coacting with said rotor to releasably and firmly hold said rotor in any of said message presenting positions thereof.

2. For displaying selectively to motorists any of a plurality of traffic meassages, a changeable message highway sign machine comprising a casing adapted to be mounted in an overhead position proximate to a highway traffic lane to confront oncoming motorists, the motorist confronting side of said casing being shaped to form a vertical sign face, said casing defining in said sign face a message aperture, a message bearing rotor defining on the periphery thereof a plurality of message faces extending longitudinally along the rotor and being angularly spaced around the rotor, each message face being adapted to present lettering of a written message, said rotor being disposed rotatably within said casing in aligned relation to said message aperture, means journalling said rotor for rotation about the axis thereof, means coacting with said rotor to turn the rotor selectively to any of a plurality of message presenting positions thereof wherein the respective message faces thereon are disposed in viewing alignment with said message aperture to be displayed therethrough to oncoming motorists, a first internally open member on said casing extending along the lower edge of said message aperture in close proximity to the rotary path of the periphery of the rotor, heating element means extending along the interior of said first member to thermally preclude an icing bridgeover between the rotor and the lower edge of the message aperture, a second internally open member on the casing extending along the upper edge of said message aperture in close proximity to the rotary path of the rotor periphery, and heating element means extending along the interior of said second member to preclude an icing bridgeover between the rotor and the upper edge of the message aperture.

3. For displaying selectively to motorists any of a plurality of traffic messages, a changeable message highway sign machine comprising a casing adapted to be mountd in an overhead position proximate to a highway traffic lane to confront oncoming motorists, the motorist confronting side of said casing being shaped to form a vertical sign face, said casing defining in said sign face a message aperture, a message bearing rotor defining on the periphery thereof a plurality of message faces extending longitudinally along the rotor and being angularly spaced around the rotor, each message face being adapted to present lettering of a written message, said rotor being disposed rotatably within said casing in alined relation to said message aperture, means supporting said rotor for rotation about the axis thereof, rotary driving means coacting with said rotor to turn the rotor selectively to any of a plurality of message presenting positions thereof wherein the respective message faces thereon are disposed in viewing alinement with said message apeture to be displayed therethrough to oncoming motorists, a first internally open member on said casing extending along the lower edge of said message aperture in close proximity to the rotary path of the periphery of the rotor, heating element extending along the interior of said first member to thermally preclude an icing bridgeover between the rotor and the lower edge of the message aperture, a second member on the casing extending along the upper edge of said message aperture in close proximity to the rotary path of the rotor periphery, and an elongated water deflector member parallel to said sign face and sloping downwardly and outwardly over the upper marginal edge of said message aperture from the overlying portion of the sign face to deflect away from said message aperture downwardly flowing precipitation.

4. For displaying selectively to motorists any of a plurality of traffic messages, a changeable message highway sign machine comprising a casing adapted to be mounted in a position proximate to a highway traffic lane to confront oncoming motorists, the motorist confronting side of said casing being shaped to form a generally vertical sign face, said casing defining in said sign face a message aperture, a message bearing rotor defining on the periphery thereof a plurality of message faces extending longitudinally along the rotor and being angularly spaced around the rotor, each message face being adapted to present lettering of a written message, said rotor being disposed rotatably within said casing in alined relation to said message aperture, means supporting said rotor for rotation about the axis thereof, rotary driving means coacting with said rotor to turn the rotor selectively to any of a plurality of message presenting positions thereof wherein the respective message faces thereon are disposed in viewing alinement with said message aperture to be displayed therethrough to oncoming motorists, a member on said casing extending along the lower edge of said message aperture in close proximity to the rotary path of the periphery of the rotor and having an inner side, and heating element means extending along the inner side of said member to thermally preclude an icing bridgeover between the rotor and the lower edge of the message aperture.

5. A sign machine according to claim 4, in which said heating element means includes electrical resistance heating means.

6. For displaying selectively to motorists any of a plurality of traffic messages, a changeable message highway sign machine comprising a casing adapted to be mounted in a position proximate to a highway traffic lane to confront oncoming motorists, the motorist confronting side of said casing being shaped to form a generally vertical sign face, said casing defining in said sign face a message aperture, a message bearing rotor defining on the periphery thereof a plurality of message faces extending longitudinally along the rotor and being angularly spaced around the rotor, each message face being adapted to present lettering of a written message, said rotor being disposed rotatably within said casing in alined relation to said message aperture, means journalling said rotor for rotation about the axis thereof, means coacting with said rotor to turn the rotor selectively to any of a plurality of message presenting positions thereof wherein the respective message faces thereon are disposed in viewing alinement with said message aperture to be displayed therethrough to oncoming motorists, a first member on said casing extending along the lower edge of said message aperture in close proximity to the rotary path of the periphery of the rotor and having an inner side, heating element means extending along the inner side of said first member to thermally preclude an icing bridgeover between the rotor and the lower edge of the message aperture, a second member on the casing extending along the upper edge of said message aperture in close proximity to the rotary path of the rotor periphery and having an inner side, and heating element means extending along the inner side of said second member to preclude an icing bridgeover between the rotor and the upper edge of the message aperture.

7. A sign machine according to claim 6, in which each of said heating element includes electrical resistance heating means.

8. A sign machine according to claim 6, including a water deflector projecting downwardly and outwardly from said second member and over the upper edge of said message aperture to deflect precipitation from said rotor.

9. For displaying selectively to motorists any of a plurality of traffic messages, a changeable message highway sign machine, comprising a casing adapted to be mounted in a position proximate to a highway traffic lane to confront oncoming motorists, said casing having a motorist confronting sign face formed with a message aperture, a message bearing rotor disposed in said casing and having a plurality of peripheral message faces spaced at angular intervals around said rotor, means in said casing rotatably supporting said rotor for rotation behind said message aperture to bring said message faces successively into view through said message aperture, a rotary electric motor in said casing for driving said rotor, transmission means connected between said motor and said rotor for indexing said rotor in response to operation of said motor to bring each message face in turn into view through said message aperture, a locating cam connected to and rotatable with said rotor and having a plurality of lobes with recesses therebetween corresponding to said message faces, a cam follower for engaging said cam and for reception in said recesses to locate said cam and said rotor with each of said message faces accurately alined in turn with said message aperture, means movably mounting said cam follower in said casing for movement into and out of engagement with said cam, biasing means for biasing said cam follower toward said cam to urge said cam follower into said recesses against displacement by vibrations and air movement, an electrical solenoid connected to said cam follower for moving said cam follower away from said cam to release said rotor for rotation by said electric motor and said transmission means, and means for energizing said solenoid when said motor is energized while deenergizing said solenoid when said motor is deenergized, said cam follower being withdrawn from said cam by said solenoid when said rotor is being indexed by said motor, said cam follower being returned against said cam by said biasing means to accurately locate said rotor and to retain said rotor in its located position when said motor is deenergized.

10. A sign machine according to claim 9, in which said biasing means includes weight means operable by gravity to bias said cam follower toward said cam.

11. A sign machine to claim 9, in which said cam follower includes a roller for engaging said cam and for reception in said recesses.

12. A sign machine according to claim 9, in which said sign face includes a second message aperture, said sign machine including a second message bearing rotor disposed in said casing and having a plurality of peripheral message faces speced at angular intervals around said second rotor, means in said casing rotatably supporting said second rotor for rotation behind said second message aperture to bring said message faces of said second rotor successively into view through said second message aperture, drive means for connecting said second rotor to said transmission means for indexing said second rotor simultaneously with said first rotor in response to operation of said motor, a second locating cam connected to and rotatable with said second rotor and having a plurality of lobes with recesses therebetween corresponding to said message faces of said second rotor, a second cam follower for engaging said second cam and for reception in said recesses of said second cam to locate said second cam and said second rotor with each of said message faces thereof accurately alined in turn with said second message aperture, means movably mounting said second cam follower in said casing for movement into and out of engagement with said second cam, and connecting means for causing said second cam follower to move simultaneously with the first mentioned cam follower, said second cam follower being withdrawn from said second cam by said solenoid when said second rotor is being indexed by said motor, said second cam follower being returned against said second cam to accurately locate said second rotor and to retain said second rotor in its located position when said motor is deenergized.

13. For selectively displaying traffic messages to motorists, a changeable message highway sign machine, comprising a casing adapted to be mounted in a position proximate to a highway traffic lane to confront oncoming motorists, said casing having a motorist confronting sign face formed with first and second message apertures, first and second message bearing rotors disposed in said casing behind the respective first and second message apertures, each of said rotors having a plurality of peripheral message faces spaced at angular intervals around said rotor, first and second means in said casing rotatably supporting the respective first and second rotors for rotation behind the respective first and second message apertures to bring the respective message faces of the respective rotors successively into view through the respective message apertures, a rotary electric motor in said casing for driving both of said rotors, transmission means connected between said motor and said first and second rotors for indexing both rotors in response to operation of said motor to bring the respective message faces in turn into view through the respective message apertures, first and second locating cams connected to and rotatable with the respective first and second rotors, each of said cams having a plurality of lobes with recesses therebetween corresponding to the message faces of said rotor, first and second cam followers for engaging the respective first and second cams and for reception in the recesses thereof to locate the respective cams and rotors with each of the respective message faces thereof accurately alined in turn with the respective message apertures, means movably mounting said first and second cam followers in said casing for movement into and out of engagement with the respective first and second cams, and biasing means for biasing said cam followers toward the respective cams to urge the respective cam followers into the recesses of the respective cams against displacement by vibrations and air movement.

14. A sign machine according to claim 13, including releasing means for counteracting said biasing means to release said first and second rotors for easy indexing movement by said motor and said transmission means.

15. A sign machine according to claim 13, including an electrical solenoid connected to said first and second cam followers for urging the respective cam followers away from the respective first and second cams to release the respective first and second rotors for easy indexing movement by said motor and said transmission means.

16. For displaying selectively to motorists any of a plurality of traffic messages, a changeable message highway sign machine, comprising a casing adapted to be mounted in a position proximate to a highway traffic lane to confront oncoming motorists, said casing having a motorist confronting sign face formed with a message aperture, a message bearing rotor disposed in said casing and having at least three peripheral message faces spaced at angular intervals around said rotor, means in said casing rotatably supporting said rotor for rotation behind said message aperture to bring said message faces successively into view through said message aperture, and powder indexing means for indexing said rotor to bring each message face in turn into view through said message aperture, said rotor having at least three substantially parallel longitudinal corner chords with a multiplicity of skeletal truss braces secured between the successive adjacent chords to form a three-dimensional skeletal truss structure having a strength to resist bending in all directions, each corner chord having a hollow cylindrical longitudinal body with a pair of substantially flat longitudinal flanges formed integrally with said body and projecting therefrom toward the two adjacent corner chords of said rotor, said skeletal braces being secured to said flanges and extending between the confronting flanges of the adjacent corner chords, and at least three thin flat longitudinal sign panels secured to an extending between the confronting flanges of the adjacent corner chords, said sign panels having said message faces thereon.

17. A sign machine according to claim 16, in which there are three of said message faces and three of said corner chords on said rotor, said rotor being substantially triangular in crosssectional shape, each of said corner chords having its flanges extending with an angle of approximately 60° therebetween.

18. A sign machine according to claim 16, in which there are four of said message faces and four of said corner chords on said rotor, said rotor being approximately square in cross-sectional shape, each of said corner chords having its flanges extending with an angle of approximately 90° therebetween.

* * * * *

UNITED STATES PATENT OFFICE

CERTIFICATE OF CORRECTION

Patent No. 4,015,349 Dated April 5, 1977

Inventor(s) Samuel B. Dunne

It is certified that error appears in the above-identified patent and that said Letters Patent are hereby corrected as shown below:

Col. 1, line 35, "direction" should be --directions--

Col. 2, line 55, "emboidments" should be --embodiments--

Figure 8:
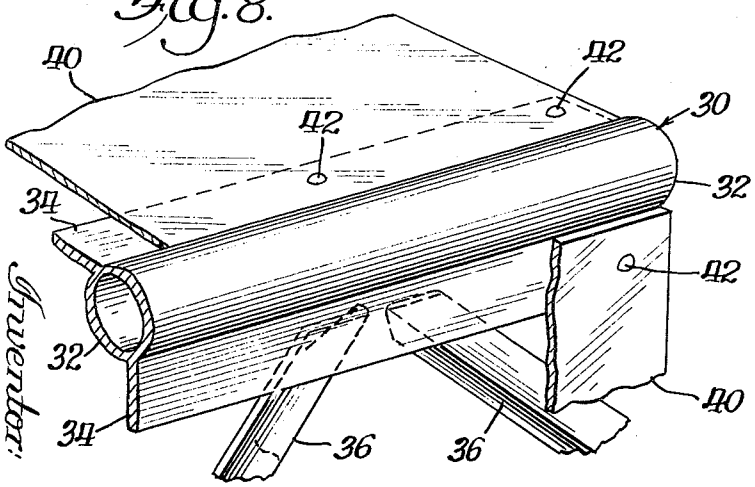
FIG. 8 is a fragmentary perspective view with certain parts broken away of the rotor taken generally with reference to the line 8—8 of FIG. 8.

Col. 3, line 14, "Fig. 8" should be --Fig. 7--

Col. 3, line 60, "entirely" should be --entirety--

Col. 4, line 35, "complusory" should be --compulsory--

Col. 5, line 31, "25" should be --26--

Col. 6, line 59, "installation" should be --installations--

Col. 6, line 65, before "advantageous" should be inserted --it is--; "is advantaeous" should be cancelled.

Col. 8, line 60, "structure support" should be --support structure--

Col. 9, line 15, "turing" should be --turning--

Col. 10, line 11, "medical" should be --medial--

Col. 10, line 19, "medical" should be --medial--

Col. 11, line 7, "messae" should be --message--

Col. 11, line 23, "accomodation" should be --accommodation--

Col. 11, line 41, "bearingfaces" should be --bearing faces--

Col. 11, line 56, "act" should be --art--

UNITED STATES PATENT OFFICE

CERTIFICATE OF CORRECTION

Patent No. 4,015,349 Dated April 5, 1977

Inventor(s) Samuel B. Dunne

It is certified that error appears in the above-identified patent and that said Letters Patent are hereby corrected as shown below:

Col. 14, line 4, after "aperture" a comma should be inserted.

Col. 15, line 28, "apeture" should be --aperture--

Col. 15, line 33, after "element" should be inserted --means--

Col. 17, line 26, after "machine" should be inserted --according--

Col. 17, line 33, "speced" should be --spaced--

Col. 18, line 54, "powder" should be --power--

Col. 19, line 1, "an" should be --and--

Col. 19, line 8, "crosssectional" should be --cross-sectional--

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*